US006915832B2

(12) United States Patent
Stern, Jr.

(10) Patent No.: US 6,915,832 B2
(45) Date of Patent: Jul. 12, 2005

(54) PROTECTION DEVICE FOR AN OVERHEAD DOOR

(76) Inventor: Edward J. Stern, Jr., 22018 N. Saddle Mt. La., Colbert, WA (US) 99005

( * ) Notice: Subject to any disclaimer, the term of this patent is extended or adjusted under 35 U.S.C. 154(b) by 176 days.

(21) Appl. No.: 10/052,854

(22) Filed: Oct. 25, 2001

(65) Prior Publication Data

US 2003/0079845 A1 May 1, 2003

(51) Int. Cl.[7] ..... E05D 15/22; E05D 15/16
(52) U.S. Cl. ..... 160/205; 160/201
(58) Field of Search ..... 160/113, 201, 160/205, 209; 49/70, 197, 198, 199, 54

(56) References Cited

U.S. PATENT DOCUMENTS

| | | | | |
|---|---|---|---|---|
| 2,113,587 A | | 4/1938 | Gorar | |
| 3,313,338 A | | 4/1967 | Knight | |
| 3,712,013 A | * | 1/1973 | Kalus | 52/582.2 |
| 3,839,824 A | | 10/1974 | Ellis et al. | |
| 4,356,668 A | | 11/1982 | Wagner | |
| 4,653,566 A | | 3/1987 | Miale | |
| 4,655,002 A | | 4/1987 | Everson | |
| 4,989,835 A | | 2/1991 | Hirsh | |
| 5,408,789 A | | 4/1995 | Plfeger | |
| 5,459,963 A | | 10/1995 | Alexander | |
| 5,649,396 A | | 7/1997 | Carr | |
| 5,720,332 A | | 2/1998 | Nachreiner | |
| 5,727,614 A | * | 3/1998 | Lichy | 160/201 |
| 5,860,465 A | * | 1/1999 | Eastridge et al. | 160/113 |
| 5,904,199 A | * | 5/1999 | Messner | 160/219 |
| 6,053,237 A | * | 4/2000 | Bertilsson et al. | 160/205 |
| 6,092,580 A | | 7/2000 | Lucas | |
| 6,115,963 A | | 9/2000 | Allardyce et al. | |
| 6,172,604 B1 | | 1/2001 | Heillman et al. | |
| 6,279,276 B1 | * | 8/2001 | Knoll | 52/173.2 |
| 6,315,027 B1 | * | 11/2001 | Lichy | 160/205 |
| 6,557,614 B1 | * | 5/2003 | Lampers | 160/113 |

OTHER PUBLICATIONS

TorbeckIndustries (Saf–T–Header) (2 pages); Door Protection (1 page); Published 2001.
Blue Giant Dock Safety Web Advertisement (5 pages) Nov. 15, 2001.

* cited by examiner

*Primary Examiner*—Gregory J. Strimbu
(74) *Attorney, Agent, or Firm*—Gregory I.P. Law; Randy A. Gregory

(57) ABSTRACT

An impact protection device for an overhead comprising an elongated beam shaped to at least partially span the door. The beam includes box members at the ends there of which releasably interfit with channel members at a closed position of the door to laterally secure the beam with respect to a support surface adjacent the door, (when to absorb and transmit lateral impact forces applied against the beam away from the door and against the support surface. The door and beam are connected so that elevational movement of the door will result in corresponding elevational motion of the beam.

4 Claims, 6 Drawing Sheets

PROTECTION DEVICE FOR AN OVERHEAD DOOR

CROSS REFERENCE TO RELATED APPLICATION

This application is an original U.S. Patent Application and is not related to other U.S. applications, patents, provisional patents, or to any foreign patent, utility model or similar publication.

TECHNICAL FIELD

This invention relates to a protection of overhead doors from damage by impact.

BACKGROUND OF THE INVENTION

Warehouses and manufacturing facilities commonly have sectional overhead doors to keep weather, dirt, debris and insects from entering the structure. New federal requirements for air standards in employee work areas mandate a controlled environment. Sanitation is a consideration that has brought about changes in the methods of opening sectional overhead doors to vent and cool buildings.

The new requirements are affecting building construction. Sectional overhead doors may need to be kept closed to meet air standard requirements, leaving the doors vulnerable to damage. Protecting sectional overhead doors from potential damage has thus become a concern in industry.

Several types of protection devices have been developed for sectional overhead doors to prevent damage from an impacting force. U.S. Pat. No. 5,720,332 to Nachreiner (1996) discloses a complex impact absorbing panel assembly. However, only the bottom panel of the door is protected, leaving the rest of the door unprotected. The bottom impact absorbing panel provides no protection if the door is in the fully opened position. Also, the impact panel has a series of security locks, which, if left unlatched, create a security problem.

Although security doors address different issues, protection can be provided by installing a second complete, sectional overhead security door and track adjacent to a sectional overhead door. U.S. Pat. No. 5,408,789 to Plfeger (1993) discloses a security sectional overhead door including a safety beam. However, the small area of the safety beam leaves the rest of the door unprotected from damage by vehicles or freight, and damage to both the sectional overhead door types is possible. Thus, if the sectional overhead security door were to provide protection, the operator would be required to perform additional labor for closing. Also, maintenance costs may be significant for service on the sectional overhead security door and the sectional overhead door.

Several types of thin, flat barriers exist. For example, the U.S. Pat. No. 4,356,668 to Wagner (1980) discloses barriers for sectional overhead door protection. Although inexpensive to manufacture, the barriers can be used only once in most cases. The several barriers disclosed are dependent on an elaborate system of pulleys and switches requiring periodic service to keep the systems operational.

Also, U.S. Pat. No. 5,649,396 to Carr (1997) discloses a safety barrier for use across a vehicle passageway to prevent a vehicle from moving off the end of a loading dock. However, it does not appear that the barrier provides protection for an adjacent sectional overhead door from impact by, say, a forklift fork or a pallet. Also, there does not appear to be protection for the sectional overhead door while in the opened position.

Known forms of sectional overhead door protection devices suffer from a number of disadvantages in that they: (a) Fail to provide protection for the sectional overhead door while it is in the fully opened position; (b) Become complicated with pulleys, switches and the like that require high maintenance and extra expenses; (c) Fail to withstand multitudes of impacts; and (d) Lack an ability to alert operators that the protection device is undergoing stress.

BRIEF DESCRIPTION OF THE DRAWINGS

Preferred forms of the present invention are exemplified by the accompanying drawings, in which:

FIG. 9 is an enlarged, perspective view of the beam similar to

FIG. 8 only showing associated parts removed therefrom;

DETAILED DESCRIPTION

Figure 1:
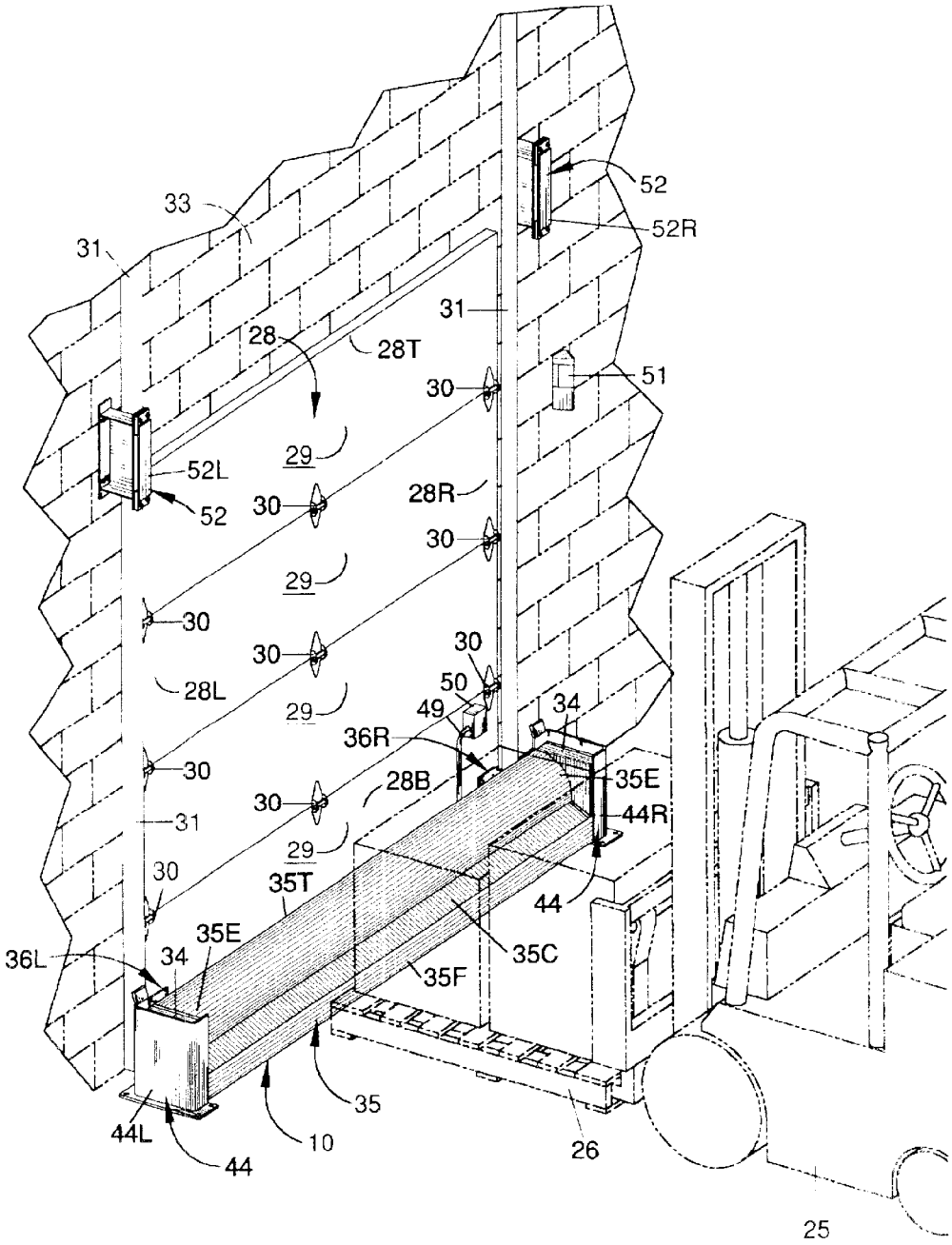
FIG. 1 is a fragmented perspective view of a preferred form of the protection device in combination with a sectional overhead door and associated structure shown in a closed position.

Before describing preferred elements of the invention in detail, general aspects of the invention as a whole will be set forth with reference to the exemplary forms shown in the drawings.

A first aspect of my invention includes a device 10 for impact protection of a sectional overhead door 28, in which the door includes top and bottom portions 28T, 28B joined by lateral edges 28R, 28L and that is movable between open and closed positions. In this aspect, the device 10 includes an elongated beam 35. The channel is supportable by interfitting channels 44 and box members 34 on the beam and a surface adjacent the door (by way of example, the channels 44 are shown to be mounted on a support surface such as a floor and the box members 34 are formed at the beam ends 35E, however these elements could be reversed so the box members 34 would be mounted to the support and the channels 44 would be on the beam). The box members 34 and channels 44 are arranged to releasably interfit at a closed position of the door and hold the beam 35 in laterally spaced relation to the door. At least one lifting rod 37 and a complimentary lifting rod receiver 38, one of which (lifting rod or receiver) is mounted on the beam 35 and the other adapted to be mounted on the door 28 and arranged to be releasably engageable such that the beam is carried responsive to motion of the overhead door between the open and closed positions thereof and so the lifting rod 37 and lifting rod receiver 38 are operably disengaged at the closed position to permit movement of the beam relative to the door 28.

In another aspect, an elongated beam 35 extends to opposed ends 35E, with a channel 44 for each beam end 35E. A box member 34 is shaped to be releasably received by the channel 44, with one of the channel 44 or box member 34 being adapted to be secured to a support such as a wall or floor adjacent to an overhead door. The other (channel 44 or box member 34) is disposed on the beam to interfit with the one channel 44 or box member 34 on the support to secure the beam 35 against lateral movement. At least one lifting rod 37 is provided, along with a lifting receiver 38, shaped to releasably receive the lifting rod 37. The lifting receiver 38 and lifting rod 37 are configured for interconnection between the beam 35 and door 28 such that elevational movement of the door 28 will cause similar elevational movement of the beam 35.

A further aspect includes a safeguarding beam device 10 for positioning in front of a sectional overhead door 28 as a vehicle impediment. The device in this aspect includes an elongated impact absorbing beam 35. At least one channel 44 is adapted to be secured to a support separate from the beam and positioned to releasably receive at least a part of the beam at a closed door position. A lifting rod 37 is configured to be mounted to the door and to project therefrom. A means for latching 41 said rod 37 to said beam is provided for elevationally moving the beam in response to elevational movement of the door. A stop 52 is configured to be mounted to a surface separate from the beam for blocking said beam from striking said door at an open position thereof.

A further aspect includes a process for protecting an overhead door 28 mounted to a wall above a floor and movable elevationally between an open and closed position. The process includes the step of mounting an elongated beam 35 to the door 28 in spaced relation thereto and spanning the door in such a manner that the beam 35 is laterally secured to the wall or floor with respect to the door 28 at a closed position of the door, and such that the beam 35 is elevationally movable by the door 28 to an open door position in which the beam 35 is suspended from the door 28.

A still further aspect includes the combination of an overhead door 28 and protecting beam device 10.

The sectional overhead door 28 includes hinged panels 29 and guide rails 31 that movably mount the door 28 for movement between an open and a closed position, an elongated beam 35 extends to opposed ends 35E. A channel 44 is provided for each beam end 35E, and a box member 34 is shaped to be releasably received by the channel. One of the channels 44 and a respective box member 34 is adapted to be secured to a support (such as a floor or wall) adjacent to the overhead door 28 to interfit with the other one of said channel 44 or box member 34 to secure the beam 35 against lateral movement when at the closed position at least one lifting rod 37 s also Provided, along with a lifting rod receiver 38, shaped to releasably receive the lifting rod. The lifting receiver 38 and lifting rod 37 are configured for interconnection between the beam 35 and the door 28 such that elevational movement of the door 28 will cause similar elevational movement of the beam 35.

Looking now in greater detail at the embodiments illustrated in the drawings, FIG. 1 illustrates a typical loading dock incorporating a sectional overhead door 28, a pallet 26 sitting on a forklift vehicle 25, and a preferred example of the present device 10.

The sectional overhead door 28 may be comprised of several door panels 29 that may be held together by a plurality of hinges 30, positioned between a plurality of door guide rails 31. The rails 31 are bolted to a wall 33, which in the illustrated example is made up of numerous, concrete masonry units of block. Of course, the present invention may function with other types of structures.

In FIG. 1, the forklift vehicle 25 is moving in the direction of the door 28 with the pallet 26 shown to be just inches above a floor surface. In the illustrated situation, but for the present device 10, either the vehicle 25 or the pallet 26 could laterally impact the closed door. The present invention, however, may effectively prevent lateral impact forces from being transmitted to the door.

In a preferred form of my invention, an impact resistant beam 35 is shown in position along the floor between a left channel 44L and a right channel 44R that are mounted to the floor to receive and secure the beam to the floor when the door is in the closed position. The beam may be retrofitted to the door, or be manufactured in combination with the door 28.

A right lifting gusset 36R and a left lifting gusset 36L may be attached to the door 28 with lift rods 37 extending from each. An exemplary gusset 36L and a pair of rods 37 formed integrally therewith is more clearly shown in FIG. 5. The gussets and rods function in interaction with the beam to move the beam elevationally in response to elevational movement of the door. It is also pointed out that more than two gussets and associated rods may be provided, depending on the size and weight of the beam 35.

In further preferred forms, left and right wall stops 52L, 52R are attached to the wall adjacent to the top of the door 28. The stops are positioned for use in the open position of the door, to transmit lateral impact forces applied against the beam to the wall, thereby diverting such forces away from the door.

Figure 9:
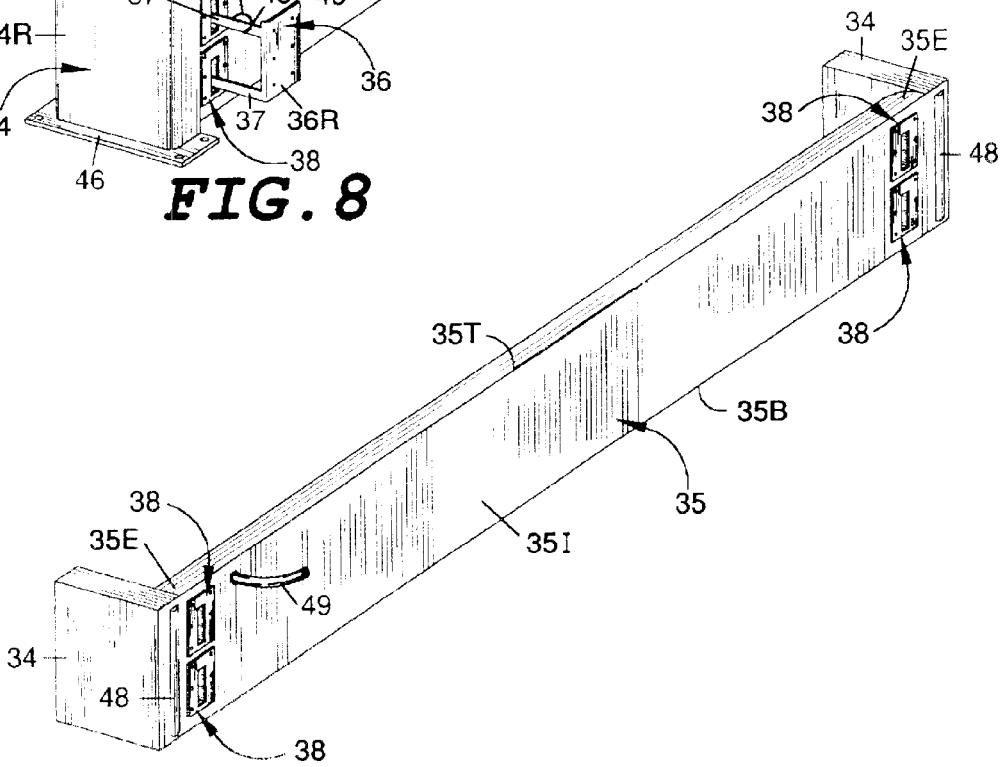

An impact edge sensor 48 (FIGS. 3, 9 and 12) may be provided on the back side of the beam 35, preferably at both ends as shown in FIG. 9. The impact edge sensor 48 may be integrated with or connected to an impact air hose 49 and to an impact air switch 50 (see schematic in FIG. 13). The impact air switch 50 may be attached to the lower sectional door panel 29 and may be electrically connected by an electrical wire to an annunciator 51. The annunciator, if electrically operable, may be powered by battery or alternating current and may be further supplied with a strobe 51 and time delay relay 60 which may be set to determine the activated or "on" time for the selected annunciator.

Figure 2:
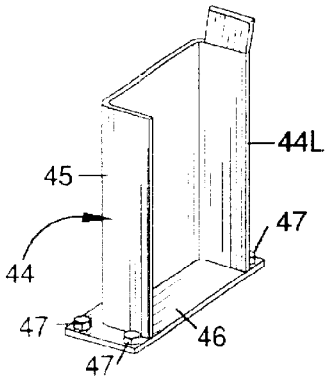
FIG. 2 is an enlarged, perspective isometric view of a preferred left side channel member of the preferred device.
Figure 10:
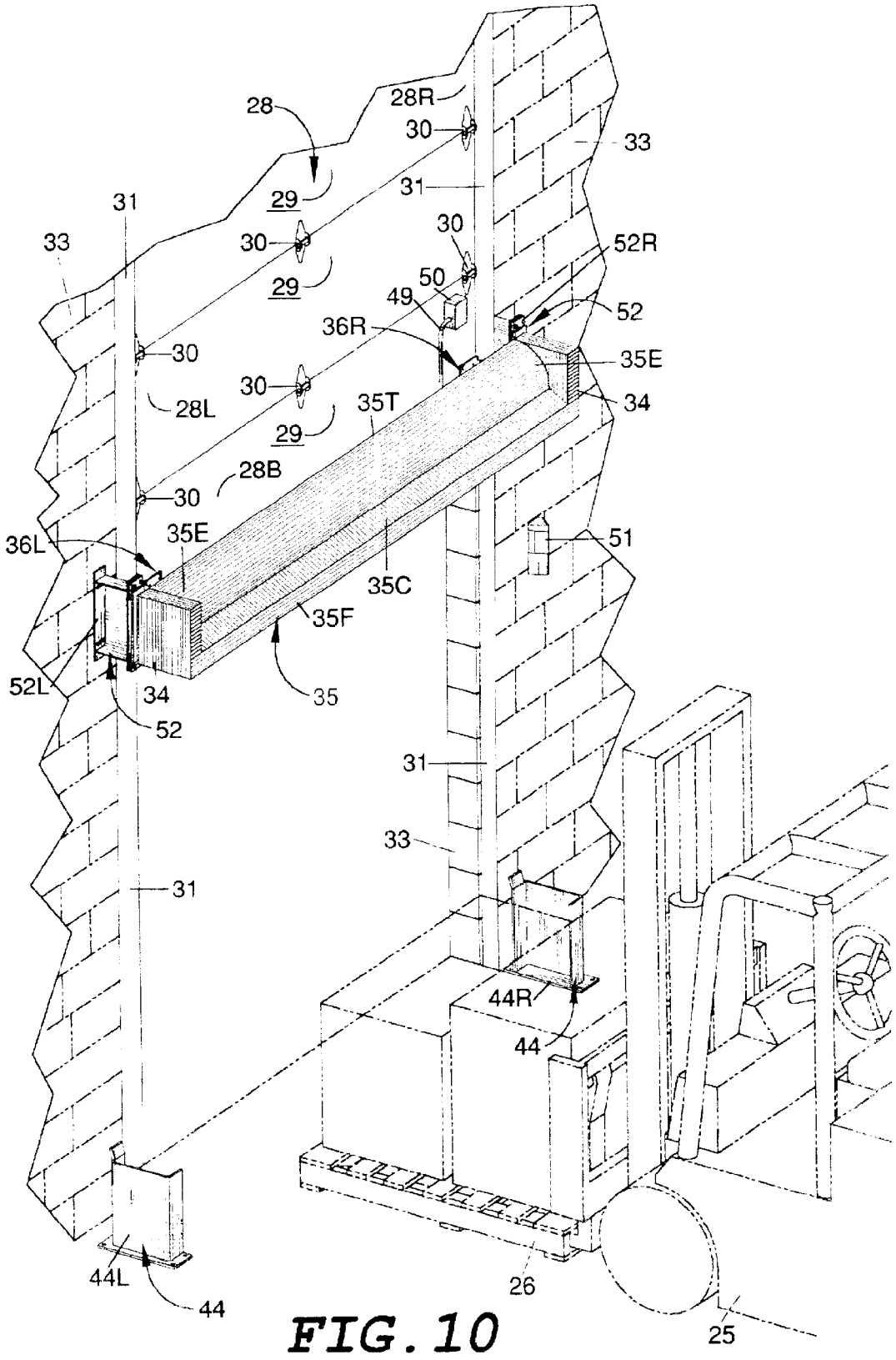
FIG. 10 is a perspective view of the preferred protection device with the sectional overhead door in an open position.
Figure 11:
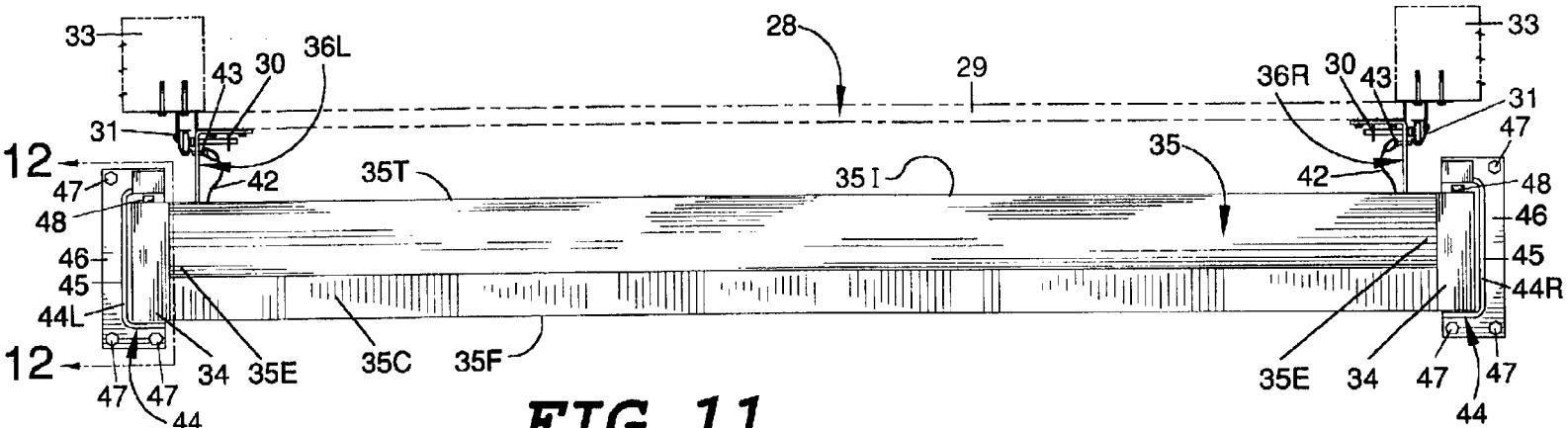
FIG. 11 is a top plan view thereof with the door and adjacent structure shown in phantom lines.

FIG. 2 shows a preferred left channel 44L which is used to hold the beam 35 preferably at its ends, along a floor or other rigid support adjacent to the sectional overhead door 28 and door rails 31 (see FIG. 1). Each channel (44L and 44R) may be comprised of a bent plate 45 that has a flat rectangular shape with ends bent inwardly. The bent plate 45 may be attached to a flat rectangular base plate 46, which protrudes from each end of the bent plate 45 to allow fastening to the floor as shown in FIG. 1 and FIG. 10 with a plurality of anchor bolts 47. The inwardly bent ends may be spaced apart by a distance slightly greater than the thickness dimension of the box members 34 on beam 35, to allow slight lateral beam movement (toward or away from the door 28) but to stop the beam from moving laterally against the door 28. The top part each channel 44L, 44R, is open to allow elevational passage of the box members 34 at the beam ends. The right channel 44R is a mirror image of the left channel 44L and may be positioned to receive the adjacent box member.

Figure 3:
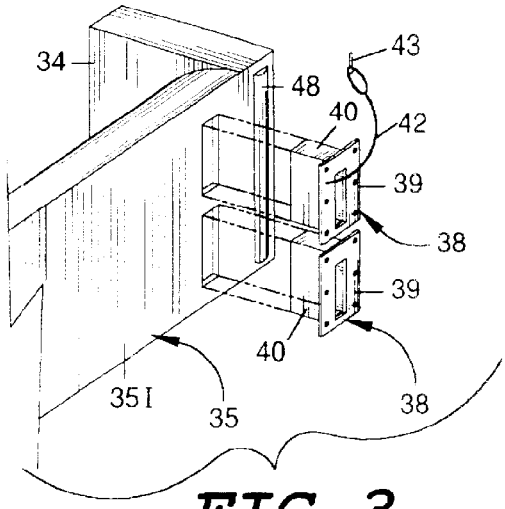
FIG. 3 is an enlarged, exploded fragmented perspective view of a lifting receiver, and a portion of a beam of the preferred protection device.
Figure 4:
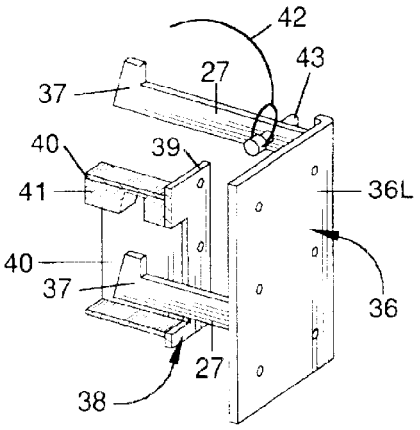
FIG. 4 is a fragmented enlarged, perspective view of a lifting gusset, a partially cut away lifting box, and a lifting plate thereof.

FIG. 3 shows the right rear or inside part 351 of a beam 35. A lifting receiver 38 is exemplified, comprising a lifting box 40 in a preferred exemplary form that is connected to a lifting plate 39 as illustrated by FIG. 4. The lifting receiver 38 preferably extends into the beam 35.

FIG. 4 indicates details of a preferred system used to loosely attach the beam 35 to a sectional overhead door 28 as the door 28 is opened. Shown is a fragmented view of one lifting receiver 38 and lift rods 37. A preferred form of lifting rod 37 includes at least one flat rectangular bar 27 (and preferably two bars 27 for each gusset 36) with a notched outer end. The lifting rods 37 are bent, preferably perpendicular to the respective flat rectangular lift gussets 36. The rods 37 are preferably loosely received by lifting receivers 38.

The preferred lifting boxes 40 are each formed of four flat rectangular sides connected to each other to form a box shape, all of which may be mounted to the beam 35. The lifting boxes 40 may each have a depth long enough to accommodate a respective notched rectangular lifting receiver latch means 41, at the upper side of the lifting box 40. The respective lifting rods 37 may be positioned through the lifting plates 39 and inside the lifting box 40, to engage the latch means 41 when the door is opened or moved elevationally. The rods 37 may disengage the latch means (as exemplified in FIG. 4) when the door is fully closed.

It is noted that the respective mounting locations for the receivers and lifting rods could be other than as shown. For example, more than two sets of receivers 38 and rods 37 could be provided, according to the size and weight of the beam 35. Also, it is possible for the lifting rods 37 to be mounted to the beam 35, and the receivers 38 to be mounted to the door. It is further conceivable that receivers 38 and rods 37 be alternated, with one mating set (rods and receivers) arranged with rods on the door and receivers on the beam, and another mating set with rods on the beam and receivers on the door. Similar interchangeability, modification, or alteration of parts may also be accomplished with other components described and illustrated herein, as noted with respect to the channels 44 and box members 34.

As depicted, the lifting receiver 38 and the lifting rod 37 are at their unlocked positions (FIG. 4) when the door 28 is in the closed position. Further details of this operation are provided below.

Figure 5:
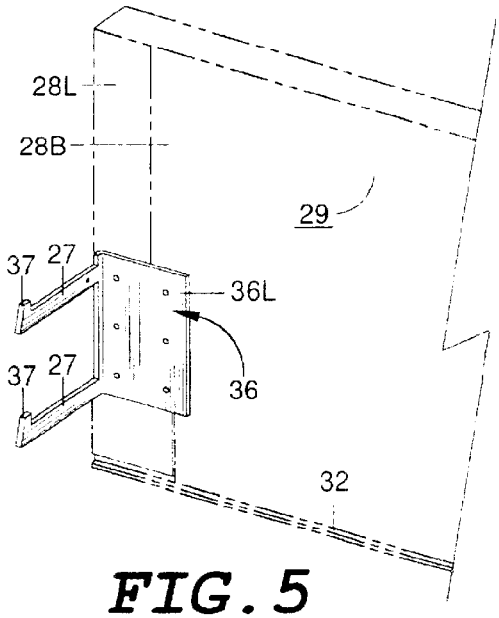
FIG. 5 is an enlarged, perspective view of a left side section of a sectional overhead door in phantom outline, with a lifting gusset of the preferred device in position thereon.

FIG. 5 illustrates a sectional door panel 29 at the door bottom 28B and a left lifting gusset 36L which is used to help raise and lower the beam 35. The sectional door panel 29 is connected by hinges 30 to the sectional overhead door 28 as shown in FIG. 1. The left lifting gussets 36L may be attached to the bottom sectional door panel 29 along the left edge of the door. Another gusset is preferably provided adjacent the opposed right door edge to interact with an associated lifting receiver at the adjacent beam end. Lifting rods 37 on the gussets 36L, 36R will protrude outward at substantial right angles to the lifting gussets 36 to engage the receivers 38. A door seal 32 is attached to the bottom edge of the sectional door panel 29.

Figure 6:
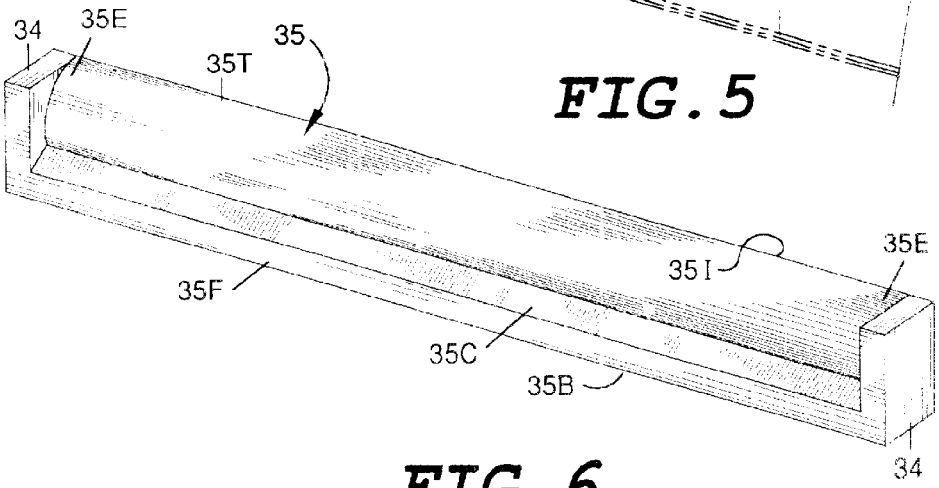
FIG. 6 is an enlarged, perspective view of the preferred beam.

FIG. 6 is a frontal perspective view showing preferred form of the beam 35. As noted earlier, the beam 35 may be produced of an impact resistant plastic. One exemplary plastic is other appropriate impact resistant materials may be used, and be produced using conventional forming or fabricating technology such as rotation molding, blow molding, or other thermoforming processes, injection molding, fabrication by welding, mechanical fastening, adhesion, or other forming techniques or combinations thereof. Further, the beam may be made using composite materials such as, but not limited to glass impregnated resin, carbon fiber, or a combination of such materials. Still further, the beam may be made of metal or a combination of metal and a plastic material. Whatever the selected material, it is desired that the beam be constructed to withstand substantial impact.

Figure 8:
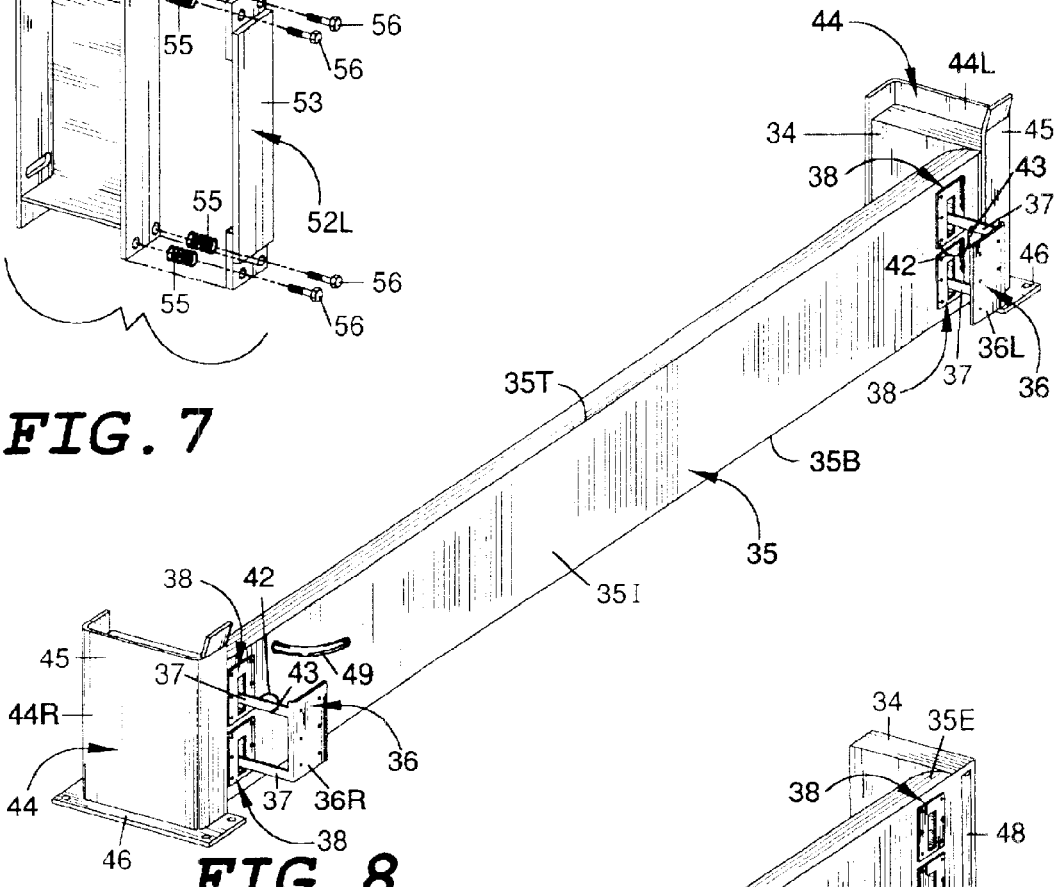
FIG. 8 is an enlarged, perspective view of an inner surface of the beam with associated parts of the preferred device.
Figure 12:
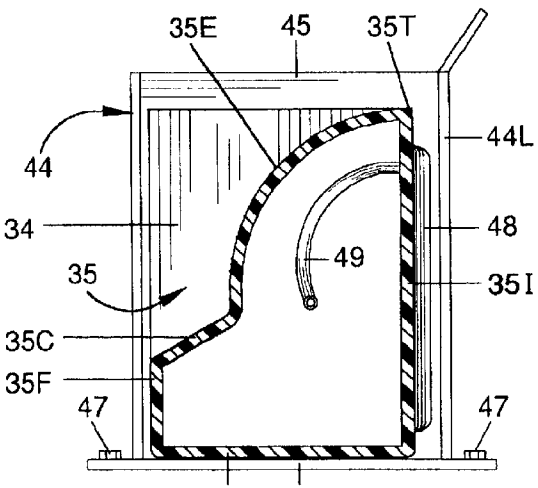
FIG. 12 is an enlarged sectional view taken substantially along line 12—12 in FIG. 11.
Figure 13:
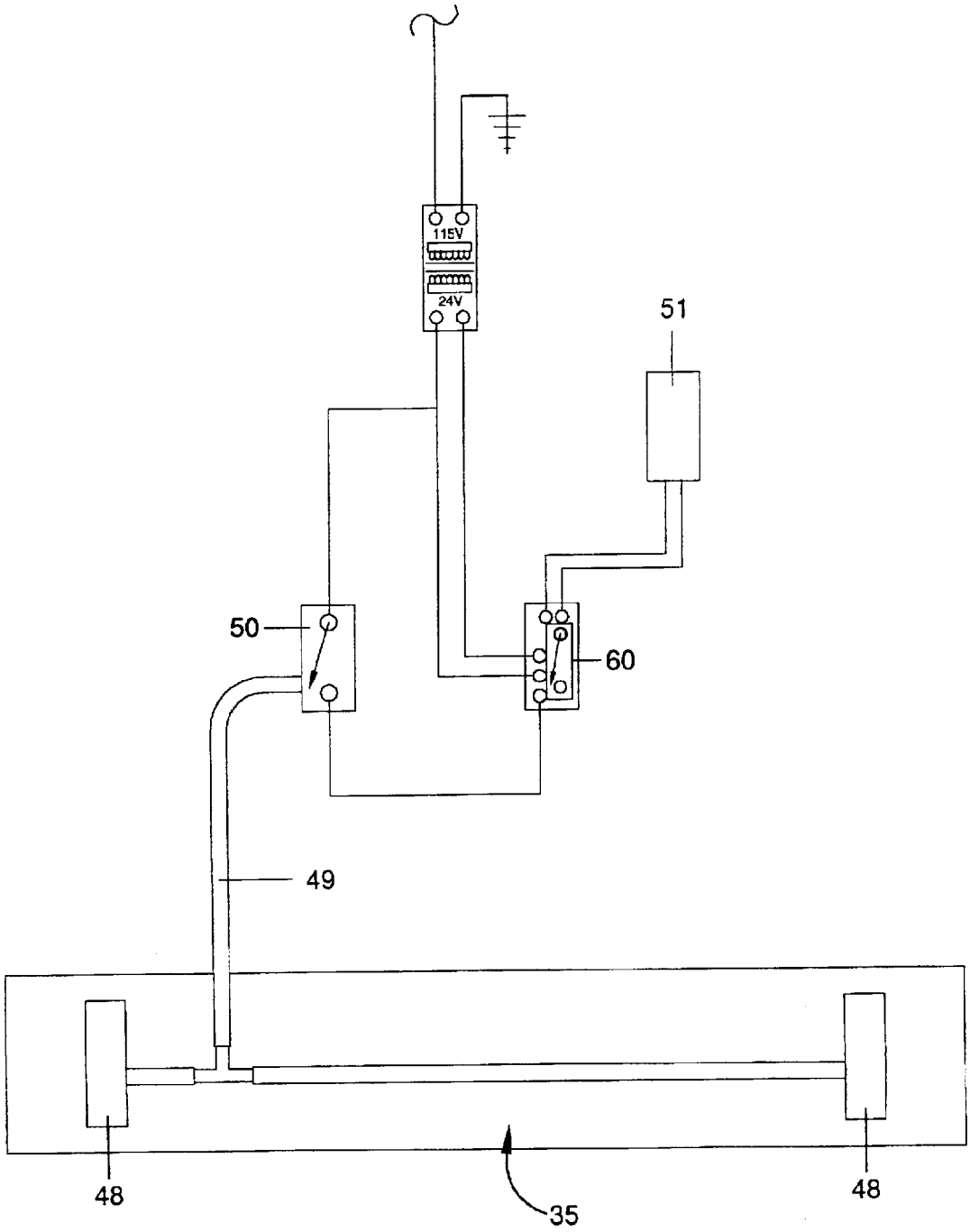
FIG. 13 is a schematic of an impact annunciator circuit.

In the examples illustrated, the preferred beam configuration includes a box shaped member 34 at each end, that is slightly less in size to accommodate the inside width, depth, and height of the channels 44L, 44R (which may be secured to the floor as shown in FIG. 8 and FIG. 1). The beam configuration between the box members 34 is shaped to transmit impact forces to the floor. Starting at the bottom front edge between the box ends 35E, the beam has a front surface 35F (FIG. 12) that extends upward vertically to about the height of a conventional wooden pallet 26. The beam surface then angles back and upwardly to form an inclined cam surface 35C that terminates about a third of the way through the thickness of the beam (between the front 35F and inside surface 35I). There, the surface turns vertically and continues to extend in a partially cylindrical or arcuate shape until it reaches the top of the beam 35T. At the beam top 35T, the surface of the beam 35 bends and extends in a downward direction vertically, forming the inside surface 35I until it intersects with a bottom surface 35B, thence turning inwardly and continuing to extend until it intersects the beginning. As shown in FIG. 12, this shape may be hollow, with the various wall thicknesses varying according to the anticipated rigidity requirements.

The above-described beam 35 shape is configured to divert forces from lateral impact at the front of the beam 35 (as delivered by a load or forks of a delivery vehicle) downwardly and toward the door. the impact loading is thus borne by the beam, the channels 44L, 44R; and the floor. Thus, little if any, impact energy is delivered to the door. Note that the lifting rods and latching arrangement function during such impact to avoid transmission of the impact force to the door. This is because the lifting rods are disengaged from the latch means 41 when the beam rests on the floor surface and the door is closed. Thus lateral motion of the beam may occur but because the rods and latches are disconnected, such motion is not transmitted through the rods to the door.

Figure 7:
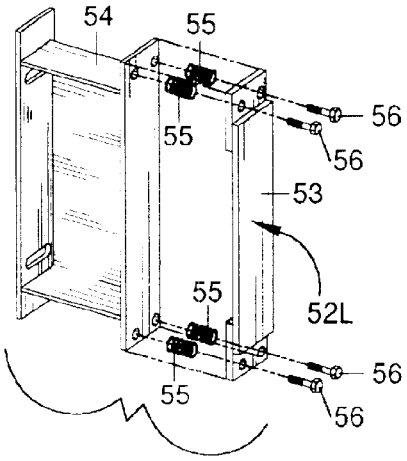
FIG. 7 is an enlarged, perspective view of a wall stop for the preferred devices with portions broken away.

FIG. 7 illustrates a preferred form of wall stop 52 that may be used as an obstruction to prevent the beam 35 from impacting the sectional overhead door 28 while the door 28 is in the open position as shown in FIG. 10. The preferred wall stops 52 include a left stop 52L and a right stop 52R. One example is shown in detail by FIG. 7. The stops 52 may be formed of flat rectangular impact plates 53, each of which is attached to a wall bracket 54 having two rectangular shapes attached to opposite ends of a channel so each end protrudes adjacent to the channel to achieve a clearance for bolting. One of the stops is preferred to be provided for each end of the beam 35. Each channel has a length that is equal to a desired spacing between the wall and beam. Springs 55 may be placed between the impact plate 53 and the wall bracket 54. A plurality of bolts 56 are inserted through holes on the impact plate 53 and center of the springs 55. Assembly of the springs, plates and bolts may be completed during installation. Tightening of the bolts 56 against compression of the springs 55 allows for adjustment of the distance between the impact plates 53 and the wall brackets 54. This adjustment is used to obtain a clearance between the beam 35 and the impact plate 53 when the door is in its fully open position as shown in FIG. 10. The stops 52 are preferably positioned between the beam ends and wall to transmit any impact forces against the beam to the wall instead of the door 28.

FIG. 8 illustrates a beam 35 that is sitting with box members 34 received in left channel 44L and a right channel 44R and shows how the receivers 38 at the ends of the beam 35 fit the receiver boxes as described in FIG. 3. There is also a latching system used to attach the beam 35 to a sectional overhead door 28. The latching arrangement comprises the series of lifting receivers 38 that are shown at each end of the beam 35, and the plurality of lifting rods 37 protruding into the lifting receivers 38 from the door. The lifting rods 37 are received as shown in FIG. 4 within the receivers 38, with a substantial degree of free relative movement allowed on all sides. This free play allows the beam 35 to move without forces being transmitted to the door through the rods 37. The latch parts 41 are positioned to receive the notched ends of the rods as the door is lifted, so the latches and notches interfit and hold the beam a prescribed distance from the door as the door moves between open and closed positions. When the door closes completely, the beam will first engage the floor; and as the door continues down, the lifting rods 37 will disengage the latch means 41 and move down substantially to the position shown in FIGS. 4 and 8.

Because the beam 35 is loosely mounted to the door 28, it becomes desirable for safety reasons to provide a cable-to-door safety cable connection shown in FIGS. 3, 4, and 8. In the example illustrated, cables 42 are secured to one or more of the lifting box receivers 38 on the beam. The cables may be attached to pins 43 on the lifting rods or gussets. The preferred cables are long enough to allow relative movement of the beam and door, but will support the beam if the receivers 38 and rods should ever become fully disengaged.

Impact edge sensors 48 (FIGS. 3, 9, 11 and 12) may be provided on each end of the beam 35, with the impact air hose 49 entering the hollow cavity of the beam 35 through a hole on the inner surface 351 of the beam 35. The impact edge sensors 48 may be connected to the impact air hose 49 inside the hollow cavity of the beam 35. A lateral impact to the beam will cause the sensors 48 to engage the guides 44, thus producing an impact signal by way of the exemplary circuitry shown in FIG. 13.

It is noted that the above is an exemplary arrangement and that other arrangements could be provided for indicating impact, if some form of impact indication is desired. Even in the example illustrated, alterations or modifications could be made. For example it is conceivable that the sensors 48 could be mounted to one or more of the channels 44 or adjacent structure for interaction with the beam ends.

FIG. 10 illustrates a typical loading dock incorporating a sectional overhead door 28 and a pallet 26 sitting on a forklift vehicle 25. Here, the sectional overhead door 28 is shown in an open position in which the several door section panels 29 have been lifted to a position above the door opening. The forklift vehicle 25 is shown to be moving in the direction of the door opening with the pallet 26 just inches above the floor.

In this orientation, the beam 35 is held in a vertical position by lifting gussets 36 and the rods 37 which are attached to the sectional overhead door 28 with the latching system previously described. The wall stops 52 may be provided here, attached to the wall 33 adjacent to the top of a doorway at each side with the beam 35 oriented parallel to and engaging the wall stops 52. The wall stops 52 are positioned between the beam and door to transmit any impact energy from the beam to the wall, rather than from the beam to the floor. Thus, the door may be protected in the open and in the closed position.

FIG. 1 portrays a typical scenario of what may happen, say in a warehouse facility. A loading vehicle 25 carrying a pallet 26 is traveling in the direction toward the beam 35 which is held just in front of the sectional overhead door 28 by the left channel 44L and a right channel 44R. If the vehicle 25 carrying the pallet 26 does not stop, the beam will be impacted. When the moving vehicle 25 and the pallet 26 contact the beam 35, the beam may deform and absorb some of the energy as a result of the beam shape, and because of its resilient and flexible properties. Part of the impact energy is also diverted from the door by the beam which is anchored in spaced relation to the door by the guides 44L and 44R. Part of the energy is also transmitted to the floor by means of the beam surface shape which functions in a wedging action between the vehicle or load and the floor. This absorption continues until the movement of the pallet 26 is arrested prior to driving into the door 25.

As the beam 35 is impacted it moves slightly backwards causing either impact edge sensor 48 shown in FIG. 3 and FIG. 9 to collapse as it is compressed against the left channel 44L, or the right channel 44R, and the beam 35. An increase in air pressure is created at an impact edge sensor 48. The impact air hose 49 carries increased air pressure to the impact air switch 50 which engages the electrical switch inside the impact air switch 50. The impact air switch 50 is connected by an electrical wire, to an annunciator 51 which is energized for a selected period of time as determined by an off-delay relay 60 (FIG. 13), thereby alerting an operator that the beam 35 has been impacted.

When a truck arrives to be loaded, the operator must open the sectional overhead door 28. As the operator opens the door 28 a series of developments take place. As the door 28 begins vertical movement in an upward direction, right and left lifting gussets 36R, 36L with the attached plurality of lifting rods 37, will engage with lifting latches 41 contained inside lifting receivers 38 (after moving a predetermined distance of travel). Once the lifting rods 37 are locked into the lifting latches 41, the beam 35 will begin to raise upward with the bottom door panel to a fully opened position as shown in FIG. 10.

While the door 28 is held in the open position the beam 35 will be in engagement or at least in alignment with the left and right wall stops 52L, 52R. If the moving vehicle 25 and the pallet 26 impact the beam 35, the beam will transmit the impact energy to the stops (and thence to the wall) by provision of the engineered shape of the beam. The beam itself may absorb some of the energy because of its resilient and flexible properties. This absorption or transmission of forces continues until movement of the pallet 26 is arrested prior to driving into the door 28. The impact will move the beam 35 slightly toward the door, causing either impact edge sensor 48 shown in FIG. 3 and FIG. 9 to collapse as it is compressed between the left wall stop 52L or the right wall stop 52R; therefore causing an increase in air pressure at an impact edge sensor 48 and resulting activation of the warning annunciator as described above.

Closing the door 28 is a reversal of the above steps beginning with the door moving downwardly. As the door 28 moves downward, so does the beam 35 (carried by the rods 37). As the door closes, the beam 35 is lowered between the right and left channels 44R, 44L. The beam 35 will stop at the bottom of the channels 44R, 44L once the floor or the channels are engaged, and the sectional overhead door 28 will continue to move downward. As the door 28 continues downward the lifting rods 37 will continue moving downwardly with the door, disconnecting from the lifting latches 41 and freeing the beam for movement confined only by the channels 44L, 44R.

As the door 28 comes to a stop, the plurality of lifting rods 37 are unlocked from the previously engaged lifting latch parts 41 as shown in FIGS. 1 and 4, and the beam is once again positioned to protect the door from impact, and is relatively free from physical rigid connection with the door. Thus when a load or vehicle impacts the beam, the beam will be in place to absorb and transmit the impact energy once again, as described above.

It may be understood from the above that the present protection device will function in a loading environment where sectional overhead doors are used. An operator can proceed with the regular course of business knowing that the protection device is guarding the sectional overhead door. The operator may also continue to open and close the sectional overhead door as always as there is no special action required for the protection device to function. Furthermore, the protection device has advantages in that it may use existing hardware to hold installation costs to a minimum. The present device may also lower maintenance costs by reducing minor impacts to the sectional overhead door. The device also aids in maintenance of sanitary building conditions by reducing door damage, which could result in bent door panels, allowing a loss of air seal to the door. The present device also lowers replacement costs by reducing damage to parts of sectional overhead doors. The present device may also increase production by instilling confidence in the operator that the sectional overhead doors are protected, and to safety by serving as a visual deterrent that an operator can see.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An overhead door guard apparatus, comprising:

at least one elongated impact absorbing beam;

at least one channel adapted to be secured to a support separate from the at least one beam and positioned to releasably receive at least one part of said at least one beam when the at least one beam is in a closed door position;

at least one lifting member and at least one lifting receiver which are each mounted to a respective one of a door and said at least one beam, and which engage for elevationally moving the beam in response to elevational movement of the door;

a stop configured to be mounted to a surface separate from the beam for blocking said beam from striking said door at an open position of said door;

wherein the at least one beam includes a front surface that is substantially vertical, an inclined surface leading angularly upwardly from the front surface to an upwardly curved surface that leads to a top surface.

2. The apparatus of claim 1 wherein the at least one beam includes at least one end having a box shape for reception by said at least one channel.

3. An overhead door protection apparatus comprising:

at least one beam of impact resisting construction extending across an overhead door in an overhead door opening;

at least one guide not mounted upon the door, said at least one guide being positioned to releasably receive said at least one beam when the beam and overhead door are moved into a closed door position;

at least one lifting member and at least one lifting receiver which are each mounted to a respected one of the door and said at least one beam, and which engage for elevationally moving the beam in response to elevational movement of the door;

a stop configured to be mounted to a surface separate from the beam for blocking said beam from striking said door at an open position of said door;

wherein the at least one beam includes a front surface that is substantially vertical, an inclined surface leading angularly upwardly from the from surface to an upwardly curved surface that leads to a top surface.

4. The apparatus of claim 3 wherein the at least one beam includes at least one end having a box shape for reception by the at least one guide.

* * * * *

UNITED STATES PATENT AND TRADEMARK OFFICE

CERTIFICATE OF CORRECTION

PATENT NO. : 6,915,832 B2
DATED : July 12, 2005
INVENTOR(S) : Edward J. Stern Jr.

It is certified that error appears in the above-identified patent and that said Letters Patent is hereby corrected as shown below:

Title page,
Item [57], ABSTRACT,
Line 1, after "overhead", insert -- door --.
Line 6, after "door,", delete "(when".
Line 9, after "beam are", delete "connected" and insert -- interconnected --.

Column 2,
Lines 38 and 39, delete the "return" after "similar to". It should read -- Fig. 9 is an enlarged, perspective view of the beam similar to Fig. 8 only showing associated parts removed therefrom; --.

Column 3,
Line 67, delete "s" and insert -- is --.

Column 5,
Line 12, delete "351" and insert -- 35I --.

Column 6,
Line 44, after "door.", begin the sentence with a capital letter. Delete "the" and insert -- The --.

Column 7,
Line 48, delete "351" and insert -- 35I --.

UNITED STATES PATENT AND TRADEMARK OFFICE

CERTIFICATE OF CORRECTION

PATENT NO. : 6,915,832 B2
DATED : July 12, 2005
INVENTOR(S) : Edward J. Stern Jr.

It is certified that error appears in the above-identified patent and that said Letters Patent is hereby corrected as shown below:

Column 10,
Line 37, delete “respected” and insert -- respective --.
Line 47, delete “from” and insert -- front --.

Signed and Sealed this

Twentieth Day of September, 2005

JON W. DUDAS
*Director of the United States Patent and Trademark Office*